US010109185B1

(12) United States Patent
Dubois, Jr. et al.

(10) Patent No.: US 10,109,185 B1
(45) Date of Patent: Oct. 23, 2018

(54) METHOD AND APPARATUS FOR TRAFFIC MONITORING BASED ON TRAFFIC IMAGES

(71) Applicants: Raymond G. Dubois, Jr., Palm City, FL (US); Mansour Ghomeshi, Weston, FL (US)

(72) Inventors: Raymond G. Dubois, Jr., Palm City, FL (US); Mansour Ghomeshi, Weston, FL (US)

(73) Assignee: 360fly, Inc., Fort Lauderdale, FL (US)

( * ) Notice: Subject to any disclaimer, the term of this patent is extended or adjusted under 35 U.S.C. 154(b) by 0 days.

(21) Appl. No.: 15/218,890

(22) Filed: Jul. 25, 2016

(51) Int. Cl.
*G08G 1/017* (2006.01)
*G08G 1/01* (2006.01)

(52) U.S. Cl.
CPC ..... *G08G 1/0129* (2013.01); *G08G 1/0175* (2013.01)

(58) Field of Classification Search
CPC ..... G08G 1/0129; G08G 1/0175
USPC ..... 340/937
See application file for complete search history.

(56) References Cited

U.S. PATENT DOCUMENTS 5,164,904 A * 11/1992 Sumner ..... G08G 1/0104 340/905
8,781,716 B1 * 7/2014 Wenneman ..... G01C 21/3484 701/118
2004/0034464 A1 * 2/2004 Yoshikawa ..... G08G 1/096716 701/117
2005/0043880 A1 * 2/2005 Yamane ..... G01C 21/3694 701/414
2006/0152592 A1 * 7/2006 Chishima ..... H04B 7/26 348/211.3
2009/0271101 A1 * 10/2009 Relyea ..... G08G 1/0104 701/118
2010/0211301 A1 * 8/2010 McClellan ..... G08G 1/0104 701/119
2011/0291863 A1 * 12/2011 Ozaki ..... G01C 21/3682 340/995.14
2012/0033123 A1 * 2/2012 Inoue ..... G08G 1/04 348/333.13
2012/0154606 A1 * 6/2012 Ye ..... H04L 67/2804 348/207.1

(Continued)

*Primary Examiner* — Brian Zimmerman
*Assistant Examiner* — Thang Tran
(74) *Attorney, Agent, or Firm* — Daniel C. Crilly; Mansour Ghomeshi

(57) ABSTRACT

A method and apparatus for monitoring traffic based on traffic images includes a server that receives traffic image data from applications running on mobile devices. The traffic image data includes location data together with image data corresponding to images of traffic on passageways traveled by the mobile devices as captured by cameras associated with the mobile devices. The server stores the traffic image data in a data store and makes the traffic images available to other computing devices (e.g., mobile devices) in response to receipt of requests that indicate locations for which the images are desired. The server may also be programmed to perform image recognition processes on the traffic images to recognize the presence and proximities of vehicles in the traffic images, and based thereon, determine traffic congestion at the locations where the traffic images were produced. The traffic congestion data may also be shared with other mobile devices.

13 Claims, 5 Drawing Sheets

(56) References Cited

U.S. PATENT DOCUMENTS

| | | | | |
|---|---|---|---|---|
| 2013/0106622 | A1* | 5/2013 | Paul | G08G 1/0116 340/933 |
| 2015/0051823 | A1* | 2/2015 | Joglekar | G08G 1/0145 701/118 |
| 2015/0081399 | A1* | 3/2015 | Mitchell | G06Q 10/0639 705/7.38 |
| 2015/0105094 | A1* | 4/2015 | Kotecha | H04W 24/02 455/452.2 |
| 2015/0161464 | A1* | 6/2015 | Hansen | G06K 9/00791 382/105 |
| 2016/0055744 | A1* | 2/2016 | Branson | G08G 1/07 340/916 |
| 2016/0057335 | A1* | 2/2016 | Pisz | H04N 5/23206 348/149 |
| 2016/0116292 | A1* | 4/2016 | An | G01C 21/26 701/454 |
| 2016/0134717 | A1* | 5/2016 | McNeill | H04W 4/029 709/217 |
| 2016/0284212 | A1* | 9/2016 | Tatourian | G08G 1/0133 |
| 2016/0358463 | A1* | 12/2016 | Cho | G08G 1/0145 |
| 2017/0053169 | A1* | 2/2017 | Cuban | H04N 7/185 |
| 2017/0061793 | A1* | 3/2017 | Witte | G08G 1/012 |

* cited by examiner

METHOD AND APPARATUS FOR TRAFFIC MONITORING BASED ON TRAFFIC IMAGES

BACKGROUND

The present disclosure relates generally to indicating recent or live traffic conditions. More particularly, the present disclosure relates to processing images sourced from cameras deployed in vehicles to determine traffic conditions at the locations where such images are captured, and to make such images available to requesters.

Smart phones have enabled numerous mobility-based services. They are often used to run, for example, driving navigation applications that display maps and indicate the directions to a selected destination. Some applications provide an indication of traffic conditions using graphic markers or color highlighting of roadways on the map to indicate various levels of traffic congestion, or reported activity such as construction.

Traffic conditions are typically determined in one of several ways. For example, there are services that use reports from observers (e.g., helicopters) to periodically update a traffic map, indicating the relative congestion or activity as observed. Another method is based on geolocation reporting by mobile devices. A mobile device running a traffic application can periodically send in location or speed data to a central server. The server, in turn, can use the location or speed data to infer congestion based on known speed limits, past history for locations, and so on. Another method is for users of mobile devices to simply report conditions and activity, where such information is then shared with other users of the service through an instance of a client application program for the service. Yet a further approach involves the use of cameras mounted at fixed positions along or in view of certain roadways and feeding back the images captured by the cameras to a traffic reporting agency.

Each of the foregoing traffic monitoring approaches has limitations. The observer-based approach doesn't provide real time updates, and is often provided as a paid subscription service. Using user-provided speed and/or location data to infer traffic may not provide sufficient information because it is based on a model of what traffic conditions should be at a given time. The use of reports provided by users depends on the accuracy of the reports. Finally, the use of images from fixed position cameras limits the locations for which accurate, real-time traffic information is obtained. Furthermore, none of these approaches provide real-time traffic images from random locations, which could provide information that does not rely on reporting or model accuracy.

BRIEF DESCRIPTION OF THE DRAWINGS

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

Figure 1:
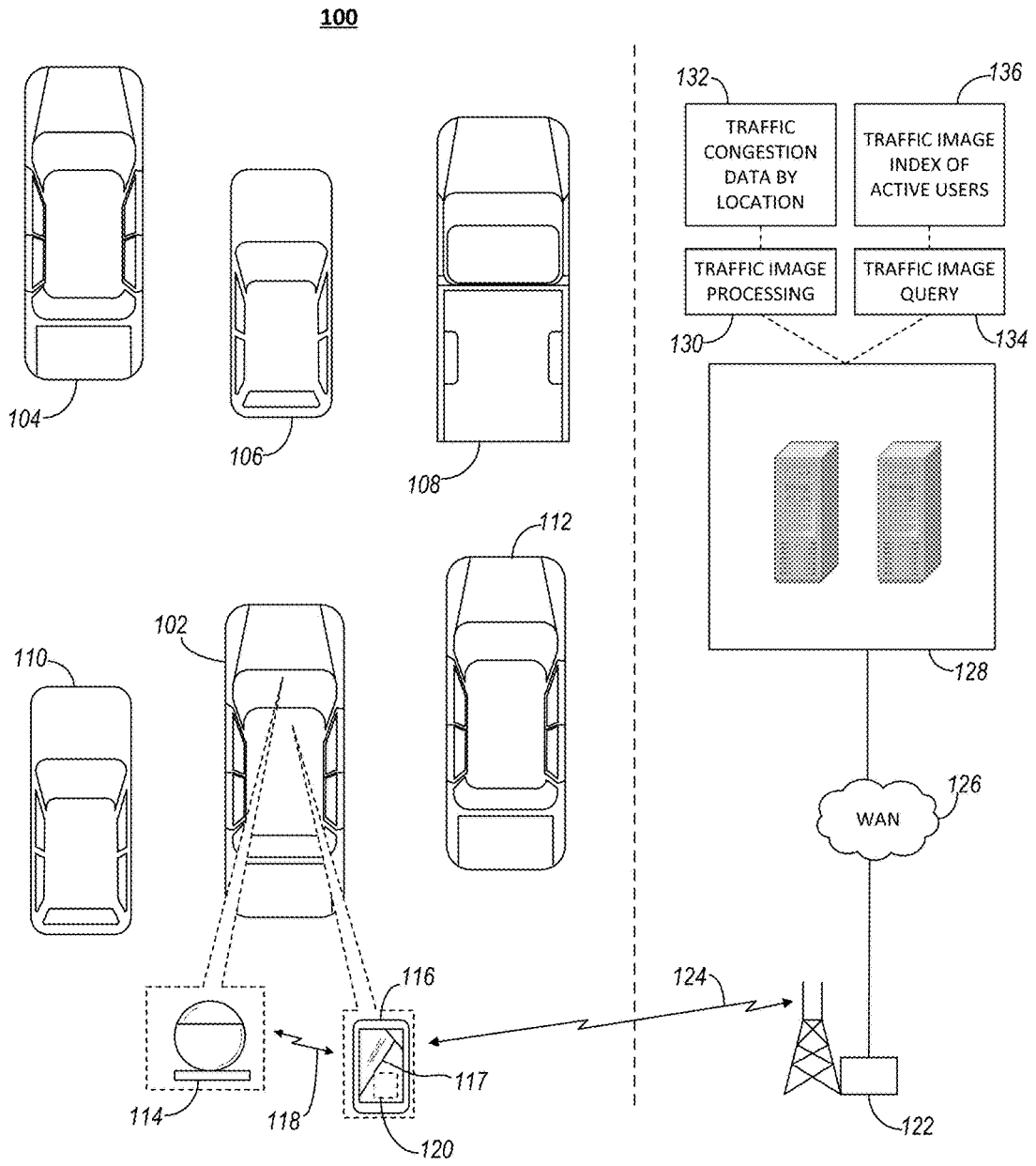
FIG. 1 is a system diagram of an exemplary traffic monitoring system, in accordance with some embodiments of the present disclosure.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The details of well-known elements, structure, or processes that would be necessary to practice the embodiments, and that would be well known to those of skill in the art, are not necessarily shown and should be assumed to be present unless otherwise indicated.

DETAILED DESCRIPTION

The inventive aspects of the disclosure can be embodied in a variety of forms, including a method, a system, an apparatus, and so on. For example, in one embodiment, a method for sharing traffic data includes receiving, at a server via one or more communication networks, traffic image data from a plurality of mobile devices, wherein the traffic image data includes images of traffic on passageways over which the mobile devices are traveling as captured by cameras associated with the mobile devices and location data indicating, for each image, a location where the image was taken. The received the traffic image data may be stored in a data store coupled to the server. After storing the traffic image data, the server may receive, via the one or more communication networks, requests for traffic images, where each request indicates a requested location and identifies a requestor. Responsive to each request, the server may retrieve from the data store image data corresponding to the requested location, and make the retrieved image data available to the requestor, such as by communicating the retrieved image data to a requestor via the one or more communication networks, by making the retrieved image data available for download or viewing from an account of the requestor at the server or another server (e.g., a web server), or otherwise.

FIG. 1 is a system diagram of a traffic monitoring system 100, in accordance with some embodiments. The system 100 involves a user or subscriber's vehicle 102 that can be in traffic including other vehicles, such as surrounding vehicles 104-112, and other vehicles not shown. The vehicles 102-112 can be travelling on a roadway, and more or fewer surrounding vehicles 104-112 may be present at different times and at different locations. The vehicles 102-112 can be travelling at differing speeds, or even essentially stopped due to traffic congestion or traffic control devices. The roadway on which the vehicles 102-112 are travelling can be any of a variety of different roadways, including a highway or a surface street. Different types of roadways can have different speed limits and various degrees of traffic control, and as a result there can be various degrees of traffic congestion and other traffic events of interest to people who travel or intend to travel on a given roadway. Additionally, the disclosed methods and systems may be readily used in connection with monitoring or reporting traffic conditions on and/or over any passageway, including roadways, waterways, and other means of passage. Where waterways are involved, the vehicles may be any types of marine vessels, including boats, yachts, tugs, barges, ferries, and other vessels. Accordingly, as used herein and in the appended claims, the term "vehicle" shall mean any motor-propelled, engine-propelled, and/or air-propelled apparatus capable of traveling on and/or over land and/or water. Additionally, the term "traffic" shall mean any collection or group of vehicles moving over any passageway or passageways.

The user's vehicle 102 may include a mobile device 116, which can be a cellular telephone device (e.g., a "smart phone"). The mobile device includes computing resources and has installed and instantiated on it a traffic monitoring application 120. The mobile device 116 can include an integral camera, as is known, which can be used for producing images and/or video of surrounding traffic (e.g., vehicles 104-112). The mobile device 116 includes a location determination circuit, which can include, for example, a Global Positioning Satellite (GPS) receiver. In some embodiments, an external camera 114 can be used in the user's vehicle 102. The external camera can be a conventional, wide-angle, or panoramic camera. Where the external camera is a panoramic camera, the external camera may be capable of producing panoramic images and/or video with a horizontal field of view of greater than 180° and up to 360° about an optical axis of the camera's lens(es). The mobile device 116 and external camera can be communicatively linked 118, such as by a short range wireless network link, which may be compatible with the Institute for Electrical and Electronic Engineers (IEEE) Specification 802.11 or 802.15.

In operation, the mobile device 116, by executing the traffic monitoring application 120, can display a traffic map 117 based on the present location of the mobile device 116 as determined by its location determination circuit. The traffic map 117 shows roadways in the vicinity of the mobile device, and hence the user's vehicle 102, as well as an indication of traffic congestion or other traffic events overlaid on the traffic map 117. For example, roadways can be highlighted with various colors which correspond with various degrees of traffic congestion. Icons representing various traffic events (e.g. accidents, construction, etc.) can be displayed overlaid on roadways on the traffic map to indicate the presence of the traffic event. The traffic monitoring application can also show, on the traffic map, the location of other users of the traffic monitoring system 100, represented as graphic objects on the roadways at locations corresponding to their present location.

The mobile device, by executing the traffic monitoring application responsive to user input, controls the camera 114 (or its own integral camera) to periodically acquire traffic images or video. The traffic images and/or video will include images of any surrounding vehicles 104-112. The traffic image data (still or video) is transmitted by the mobile device 116 to a traffic server 128 via a cellular base station 122 over a cellular data link 124, and a wide area network (WAN) 126 (e.g. the Internet). Likewise, the mobile device 116 obtains traffic congestion data from the traffic server 128 via the WAN 126 and cellular base station 122. The mobile device, by executing the traffic application, can also obtain information regarding other users of the traffic monitoring system 100, such as their present location. In some embodiments, the user of the mobile device 116 can select another user represented on the traffic map 117 and receive a traffic image recently provided by that user's equipment (e.g. camera and mobile device) to the traffic server 128.

The traffic server 128 may be a hardware-based computing resource that executes software programs for the described server functionality in accordance with the teachings herein, and can include one or more processors, central processing unit. Alternatively, the server 128 may be an application server, a web server, or any other dedicated or shared resource capable of handling the server functions of the present disclosure, Among the tasks administered by the traffic server can be the maintenance of user accounts. Every user can establish an account which will associate traffic image data and other data produced by the user with the user's account, including authentication credentials. Traffic images transmitted to the traffic server 128 by each user can be stored in association with the user's account, and they can be indexed by location and time based on the location and time information transmitted along with the traffic image data.

The traffic server 128 performs several functions with respect to the traffic image data received from user's mobile devices. One function involves processing received traffic images using a traffic image processing module 130 to identify or recognize other vehicles in the image. The traffic image processing function use automatic machine image recognition techniques to digitally process images and compare identified features in the images to image models of object to be recognized, which include other vehicles. For example, assuming the camera 114 (or the camera of mobile device 116) is set up relatively level, the tail lights of vehicles in front of the user's vehicle 102 can be recognized based on model assumptions such as there being a pair of objects that are at substantially the same height in the traffic image, and in certain expected positions in the traffic image. The distance between these objects, based on assumptions of average distance between vehicle tail lights, for example, can be used to estimate the distance to the vehicle having the recognized tail lights. Similarly, models can be produced to allow recognition of vehicles on either side of the user's vehicle 102, as well as vehicles behind the user's vehicle 102, when using a panoramic camera 114.

For each traffic image processed, a number of recognized vehicles can be determined, as well as estimated ranges between vehicles. Likewise, other traffic artifacts can be recognized in traffic images such as, for example, construction barricades, emergency vehicles, and so on. The recognition results produced by the traffic image processing module 130 are used by a traffic congestion module 132. The traffic congestion module 132 evaluates the recognition results of traffic images, and where possible, the recognition results of traffic images produced by different users in the same relative location at similar times. The number and proximity of vehicles recognized in the traffic images is used to generate traffic congestion data for a given location which indicates a relative amount of traffic along a portion of a roadway. When a mobile device periodically transmits its traffic images to the traffic server 128, its location is reported along with the traffic images. The reported location can then be used to transmit to the mobile device traffic congestion data for roadways in the vicinity of the mobile device. Upon receiving the traffic congestion data, the mobile device can overlay graphic artifacts on a displayed roadway map 117 indicating a degree of traffic congestion and other traffic events along various roadways depicted on the traffic map 117 as indicated by the traffic congestion data. The graphic artifacts can be in the form of symbols, highlight colors, or other such artifacts.

In addition to providing traffic congestion data, the traffic server 128 also facilitates traffic image sharing among users/subscribers. A user can operate the application 120 on the mobile device 116 to input a location of interest as a query in the form of an address, or indicating a location on a map, or other input indicating a roadway location, and a direction of travel. The query is then transmitted by the mobile device 116 to the traffic server 128. Received queries are processed by, for example, a traffic image query module 134, which cross references the requested location of the query with a traffic image index 136 comprised of the locations of recently acquired traffic images. Based on the requested location, the traffic image query module can identify one or more traffic images or video files that can optionally be presented to the requesting user. The traffic image query module can send a response to the requesting user with thumbnail images of the traffic images found via the index 136. The thumbnail images can be presented on the mobile device 116 to allow the user to choose one of the indicated traffic images. The choice input is then transmitted back to the traffic image query modules 134, which in turn responds by transmitting the selected traffic image to the requesting user's mobile device 116. Upon receiving the selected traffic image, the traffic monitoring application 120 can then play or display the selected traffic image on the mobile device 116. By viewing recently produced traffic images, a user can actually see the traffic conditions for a given roadway as they existed within a recent time frame, which can provide a better understanding of actual traffic conditions compared to the traffic congestion graphics on the roadway map.

Figure 2:
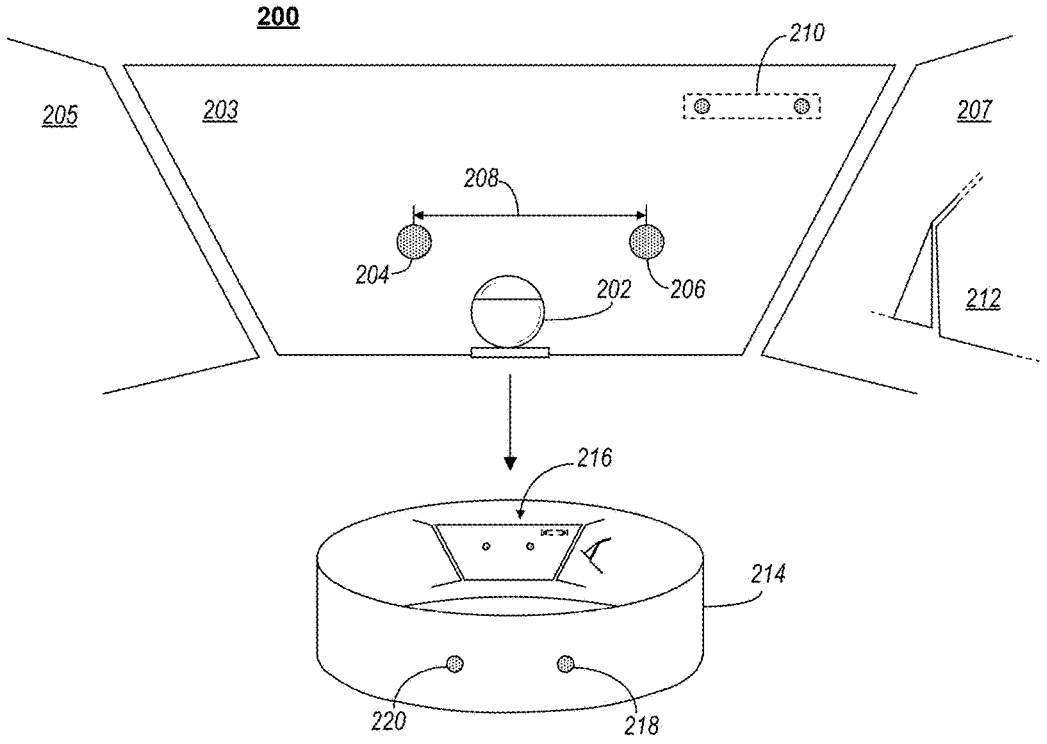
FIG. 2 is an in-vehicle view for producing traffic images processed by a traffic monitoring system, in accordance with some embodiments of the present disclosure.

FIG. 2 is an in-vehicle view 200 for producing traffic images processed by a traffic monitoring system, in accordance with some embodiments. The view 200 depicts a view from inside of a vehicle, including a front windshield 203, a left side window 205, and a right side window 207. A camera 202 can collect light and produce traffic images, which can then be transferred to a mobile device for transmission to a traffic server. The view 200 includes some features which can be used by, for example, the traffic image processing module 130, to recognize or otherwise determine the presence of a vehicle or other traffic artifact of interest in an image produced by the camera 202. For example, in front of the vehicle from which the view is shown is another vehicle having tail lights 204, 206. The tail lights represent objects that can be modeled in order to facilitate recognition. All vehicles have tail lights, and other than two-wheeled vehicles, vehicles typically have two tail lights located at opposite sides of the back of the vehicle. Various models can be developed to account for the variety of tail light design in recognizing tail lights in the traffic image. Once the tail lights 204, 206 are recognized, then a distance 208 between them can be determined in order to estimate the distance from the camera to the tail lights 204, 206. Furthermore, the tail lights 204, 206 can be recognized as being in front of the vehicle in which the camera 202 is located. Likewise, another set of tail lights 210 can be recognized, and their distance apart and position in the view 200 can be used to infer that they belong to a vehicle that is in an adjacent lane to the right, and farther away than the vehicle to which tail lights 204, 206 belong. Other vehicle features can be recognized as well, such as, for example, the side window and door section 212 of a car immediately to the right of the vehicle in which the camera 202 is located.

When the camera 202 is a panoramic camera, it produces a traffic image 214 that shows a panoramic view, which can be a three hundred sixty degree image produced by the camera 202 collecting light from three hundred sixty degrees around an optical axis of the camera 202. The traffic image 214 is shown here as a ring image which can be displayed as such or in a flattened, user-navigable form by known techniques. Features such as the side window and door section 212, tail lights 204, 206, 210 can be seen in the traffic image 214 in a portion 216. Furthermore, because the panoramic camera 202 collects light from all around it, headlights 220, 218 can be seen in a rear portion of the traffic image 214. Likewise, other surrounding features that relate to traffic condition will be captured by the camera 202 and shown in the traffic image 214. Upon transmitting the traffic image, along with location information, to the traffic server, the traffic server will process the traffic image to determine traffic feature such as other vehicles, and use this information, possibly in conjunction with the results of processing other traffic images from other users in the same or nearby location on the same roadway and heading, to produce traffic congestion data which will be indexed to the relative location of the traffic images from which the traffic congestion data was produced. Furthermore, the traffic server can index the images by location and make them available to other users to view (i.e. in response to queries).

From the position of the camera 202, a panoramic view around the camera will include occupants of the vehicle. Some users may not wish to be seen in the traffic images. Accordingly, the traffic application can include options to limit the view to the front of the vehicle, such as a substantially one hundred eighty degree view from the location of the camera 202. Assuming the camera is mounted on the dashboard or forward of the front seat occupants, then only the forward view will be made available. In some embodiments, the traffic application can accept an input to block out vehicle occupants from traffic images. When sending traffic images to the traffic server, the traffic application will include an indication to block out vehicle occupants. Upon performing the recognition process to identify vehicles, the traffic server can then also apply a facial recognition process to determine the position of any vehicle occupants and edit the traffic image to block out any detected vehicle occupants. In some embodiments the traffic application can allow a user to establish a template for traffic images by indicating on a sample image which areas of the image are to be blocked out in order to preserver user privacy. That is, the camera takes an image and presents it on the mobile device, and the user can indicate which sections of the image are to be blocked by, for example, touch input. That template can then be applied to traffic image subsequently taken to block out the corresponding regions of the traffic images before they are sent to the traffic server.

Figure 3:
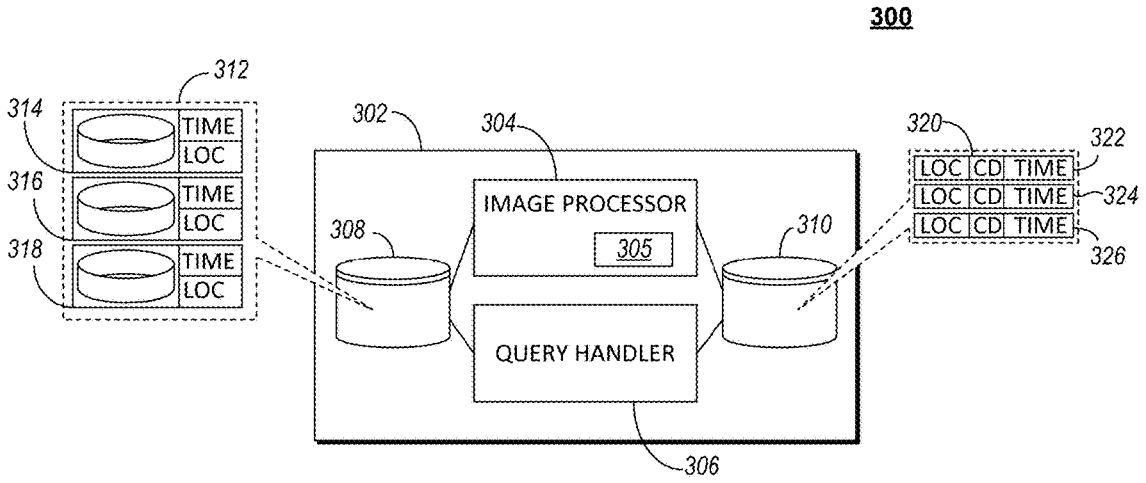
FIG. 3 is a block diagram of an exemplary server system of a traffic monitoring system, in accordance with some embodiments of the present disclosure.

FIG. 3 is a block diagram of a traffic server system 300 of a traffic monitoring system, in accordance with some embodiments. A traffic server 302 can be one of a plurality of such servers of the traffic server system, and includes a traffic image processor module 304 and a traffic query handler module 306. These modules 304, 306 perform functions substantially similar to the traffic image processing module 130 and traffic image query module 134 of FIG. 1. The modules 304, 306 represent computing machinery and circuity that run program instruction code designed to implement functionality in accordance with the teachings herein. The traffic server is coupled to or includes one or more data stores 308, 310. The data stores 308, 310 can be used to store traffic images, and traffic congestion data that are generated based on the traffic images, as well as a traffic image index 312, and a traffic congestion data index 320. The indexes 312, 320 are data structures that relate location and time to traffic images or generated traffic congestion data. For example, traffic image index 312 can include several entries 314-318 which each relate traffic image with a location (e.g. a roadway location), and a time. The traffic congestion data index 320 contains entries 322-326 that each relate traffic congestion data with locations ("LOC") corresponding to the traffic images used to generate the traffic congestion data ("CD"), and a time. Each entry in the traffic image index 312 can contain a location, and a pointer to one or more traffic images or user accounts that have traffic images taken at or near the location recently. The time for each entry is used to prune the indexes of stale entries to ensure that the traffic information (e.g. traffic images or traffic congestion data) is timely and relevant. Once an entry reaches a certain age it can be removed. In most cases since traffic conditions can be very dynamic the traffic information is only relevant for a few minutes, although in same cases it can be considered timely for tens of minutes or longer. The traffic image processor module 304 processes traffic images (both still and video) received from the mobile devices of subscribers to recognize traffic features in those traffic images. A library of models 305 can include models of traffic features that can be used to compare with the traffic images to recognize and detect traffic features. After detecting traffic features in the traffic images the traffic image processor module 304 can determine traffic congestion data for various locations. The results of processing several traffic images generated in the same location are used to determine, for example, a number of vehicles recognized in the traffic images, as well as the proximity of those vehicles. Other a priori information, such as speed limits for the location can also be used in generating traffic congestion data. The traffic congestion data can include, for example, a traffic congestion rating that indicates a relative degree of traffic congestion. The traffic congestion data can further include data indicating traffic events or the presence of things that can affect traffic. The traffic congestion data can be organized into a data structure including several fields for different types of traffic congestion data and location. Alternatively the traffic congestion data can be organized into a markup language document, such as an XML document, that facilitates rendering of graphic artifacts over a traffic map by the mobile device.

Figure 4:
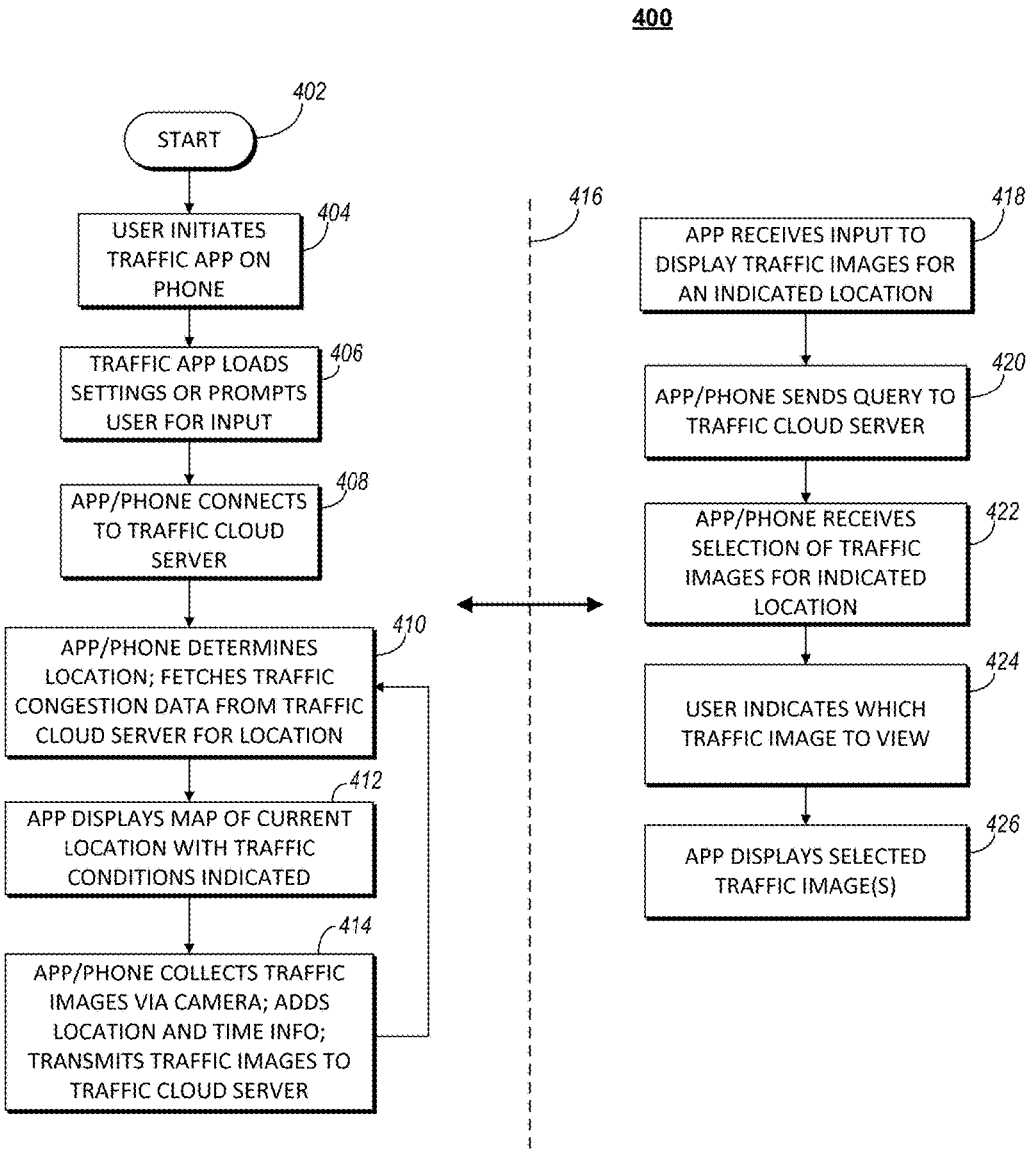
FIG. 4 is a flow chart diagram illustrating exemplary processes conducted by a mobile device in conjunction with a traffic monitoring system, in accordance with some embodiments of the present disclosure.

FIG. 4 is a flow chart diagram 400 illustrating exemplary processes conducted by a mobile device in conjunction with a traffic monitoring system, in accordance with some embodiments. As part of a system, the mobile device (e.g. a smart phone), by instantiating the traffic application, both feeds the traffic server with traffic images and presents navigation maps in graphical form with traffic congestion indications based on traffic congestion data received from the traffic server (steps 410-414), and it facilitates queries to view traffic images produced at user-requested or indicated locations (steps 418-426). These two major functions are separated by line 416, and the traffic application can switch back and forth between them based on user control input. The traffic images can be captured via an integral camera of the mobile device, or via an external camera linked to the mobile device. The traffic images can be produced in a standard image format or a panoramic format.

At the start 402 the mobile device is powered on and located in a user's vehicle. At step 404 the user initiates the traffic monitoring application on the mobile device, and at step 406 the traffic application loads user settings and account information, and may prompt the user for initial input (e.g. choose between navigation mode and traffic image query mode). In step 408 the traffic application, using the hardware resources of the mobile device, including radio communications, can connect or otherwise contact the traffic server to, for example, initiate a session. In step 410 the traffic application acquires location information from a location determination circuit of the mobile device which indicates the present location of the mobile device, and hence the vehicle in which the mobile device is located. After acquiring the location information, the traffic application/mobile device transmits the location information to the traffic server to acquire traffic congestion data for roadways on which the vehicle is located and other roadways in the vicinity of the vehicle. At the same time, the traffic application can commence displaying a roadway map for navigation in step 412. The roadway map can be a portion of a map library stored in the mobile device, or it can be acquired from the traffic server or a third party map server on an "as needed" basis as the vehicle moves along the roadways. In step 414 the traffic application commences acquiring traffic images and transmitting the acquired traffic images to the traffic server along with an indication of the location at which the traffic image was taken, and the traffic application may also add a timestamp to indicate the time at which the traffic image was produced. The traffic application can acquire traffic images from an integral camera of the mobile device, or it can use resources of the mobile device to control or interact with an external camera that has been deployed to acquire traffic images.

The traffic application can also be controlled to allow a user to see traffic images produced by other users of the traffic monitoring system. For example, after step 408 the user can operate the traffic application, such as by user interface features of the traffic application, to accept a location input in step 418, which in step 420 is transmitted by the traffic application, using the resources of the mobile device, to the traffic server. The traffic server, upon receiving the query, directs the message to a traffic image query module (e.g. 134 or 306) which locates one or more traffic images recently produced at or substantially near the indicated location. Thumbnail images of the identified traffic images are then transmitted by the traffic server to the mobile device in step 422. The traffic application can display the thumbnail traffic image(s) to allow the user to select one for viewing in step 424. Then in step 426, the traffic application requests the selected traffic image from the traffic server and displays it on the mobile device. The traffic image(s) can be either static or video images.

Figure 5:
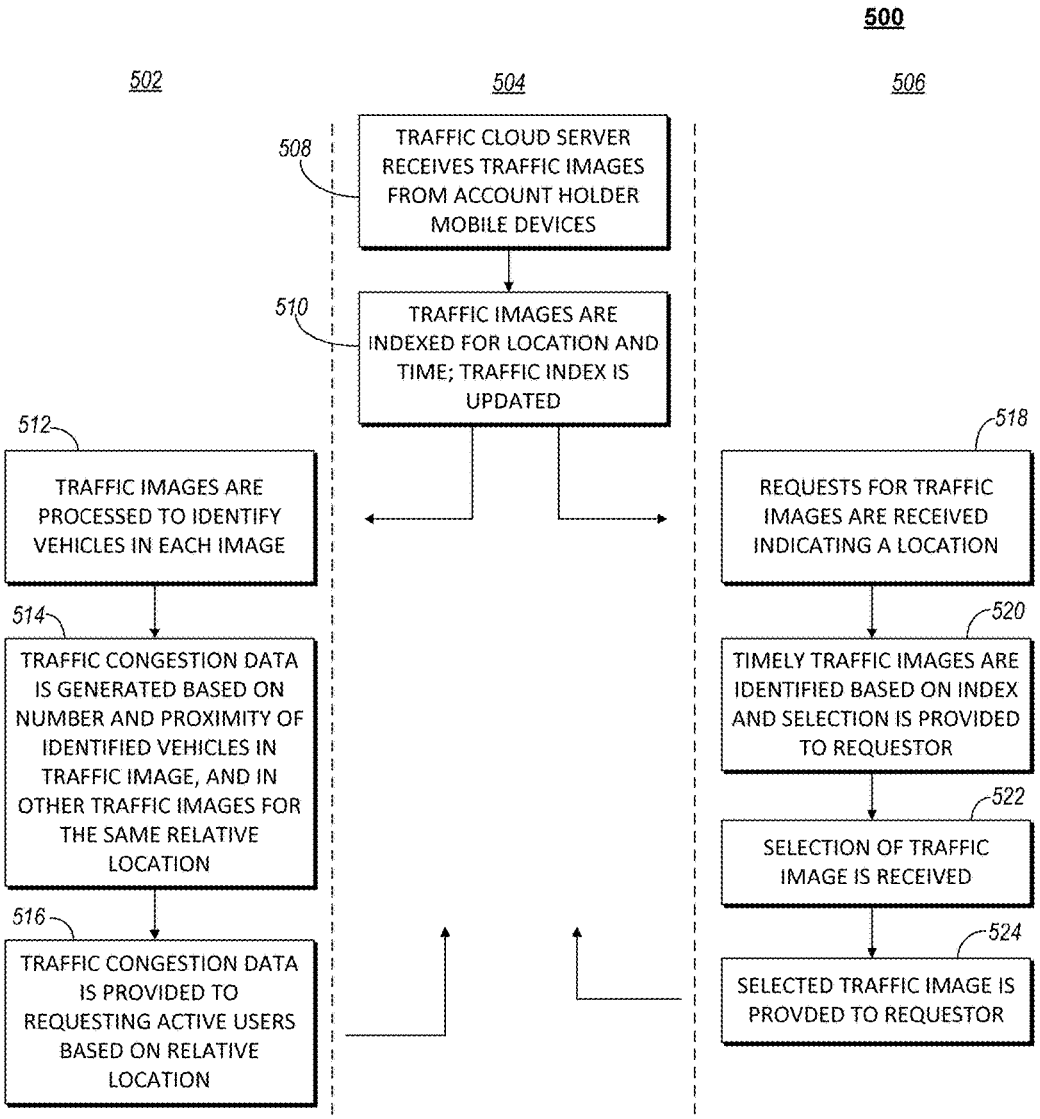
FIG. 5 is a flow chart diagram illustrating exemplary processes performed by a server for a traffic monitoring system, in accordance with some embodiments of the present disclosure.

FIG. 5 is a flow chart diagram 500 illustrating exemplary processes of a traffic server in operation for a traffic monitoring system, in accordance with some embodiments. The flow chart diagram illustrates three main functions 502, 504, 506 carried out by the traffic server. The processes to implement these functions can be carried out concurrently. In general, as illustrated by function 504, which is central to the operation of the traffic monitoring system, the traffic server receives traffic images from the plurality of users/ subscribers in step 508. In step 510, the traffic server indexes the received traffic images for location and time. The time can be indicated in metadata received with the traffic images or the traffic server can mark the present time of indexing the traffic image for the time field. The traffic images can be stored in relation to the sender's account, or any in any other suitable data structure. The index is maintained by the traffic server to allow identification of traffic images in response to queries for traffic images for a given location. The time field is used to maintain recency of the traffic images so that only relevant traffic images are kept and shared among users of the traffic monitoring system.

In function 502, the traffic server, commencing in step 512, processes received traffic images to recognize vehicles and other related traffic artifacts in the traffic images. For each traffic image, the number of vehicles recognized, and their proximity to each other can be determined. In step 514 the traffic server produces traffic congestion data based on the number and proximity of vehicles recognized in traffic images for a given location. Optimally, the traffic congestion data is based on the recognition results of several traffic images from different users at substantially the same location. The traffic congestion data is indexed by location at the traffic server and stored. As with traffic images, the traffic congestion data is time sensitive, so a time is also indexed along with location for the traffic congestion data to ensure the desired recency of the traffic congestion data. In forming the traffic congestion data, the traffic server can index by location at a region level, rather than a roadway level, in a data structure that includes fields for different portions of roadways in the region. Each of these fields can be updated as new traffic images from those roadway locations are received ad processed. When a request for traffic congestion data is received in step 516 the traffic server can provide the traffic congestion data for the entire region in which the indication location (in the request) is located, and the traffic application can modify the displayed traffic map based on how much of the region is being show by the traffic map, as set by the particular user. This allows the user to zoom in or out of the traffic map on their mobile device without necessitating another request for traffic congestion data in most cases.

In function 506, the traffic server provides traffic images to requesting users. Accordingly, in step 518, the traffic server can receive a request for traffic images for an indicated location. The indicated location is a location provided by a user as an input to the traffic application at the user's mobile device. The location does not have to be the present location of the user, rather the user may wish to see traffic images for other locations, which can be locations to which the user may intend to travel. In step 520, the traffic server locates traffic images based on the indicated or requested location, and in some embodiments the traffic server can provide a choice of several traffic images to the requesting user. In step 522, the traffic server receives a selection of a traffic image from the requesting user and, in response as indicated in step 524, the traffic server transmits the selected traffic image to the requesting user.

Figure 6:
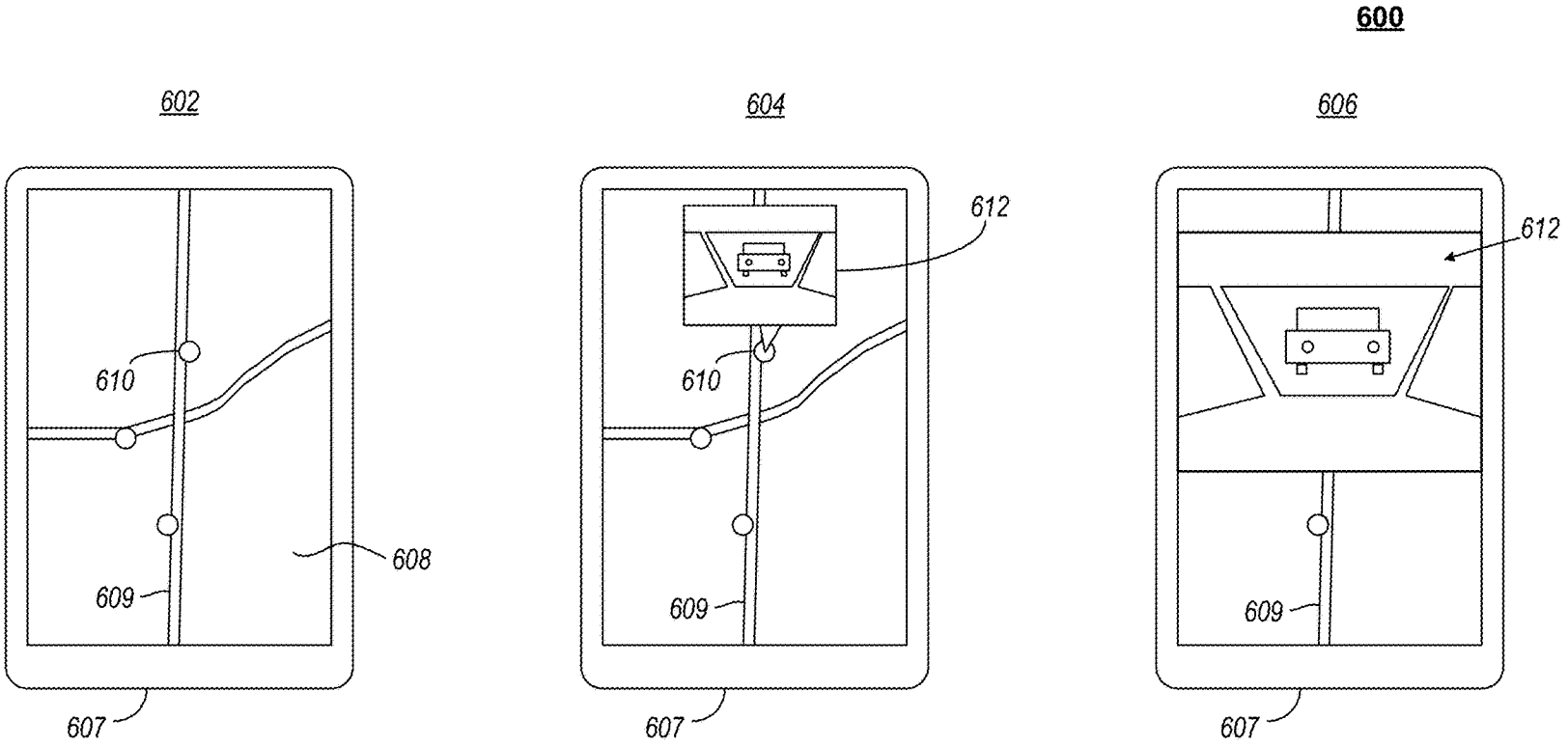
FIG. 6 is a state diagram 600 of a display state for a traffic application on a mobile device, in accordance with some embodiments of the present disclosure.

FIG. 6 is a state diagram 600 of a display state for a traffic application on a mobile device 607, in accordance with some embodiments. In a normal display state 602, the traffic application displays a roadway map 608 which can include graphical representations of roadways, such as roadway 609. The map 608 can also include graphical representations of other users of the traffic monitoring system, such as user 610. The map can be updated in a way that shows the movement of users along the roadways. If the user of the mobile device 607 wishes to see the traffic conditions at the location of user 610, the user of the mobile device 607 can select the graphical representation of user 610 to cause the traffic application to bring up a traffic image 612 in state 604. The traffic image 612 is produced by a camera in the vehicle of user 610, and stored in the traffic server for sharing. The traffic image 612 can be the more recent traffic image provided by user 610. As shown in state 604, the traffic image 612 is scaled to occupy only a portion of the display of the mobile device 607, but in state 606, the traffic image 612 can be scaled up to fill the horizontal dimension of the graphical display of the mobile device 607.

Accordingly, the present disclosure provides the benefit of supplying users with traffic congestion information based on detecting the vehicle density around users' vehicles via image recognition techniques. This approach is more reliable than systems that infer congestion solely based on user speed because it is possible for traffic to move at close to ordinary speed and still be heavily congested. Likewise, it is possible that a given user may just drive slowly, giving an inaccurate result when inferring traffic congestion based on speed. Furthermore, the present disclosure provides the benefit of allowing users to view traffic images recently provided by other users, allowing an even better understanding of the state of traffic at the locations where the traffic images were produced.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations.

We claim:

1. A method implemented by a server, the method comprising:

receiving, via one or more communication networks, traffic image data from a plurality of mobile devices, the traffic image data including location data together with image data corresponding to images of traffic on passageways over which the plurality of mobile devices are traveling as captured by cameras associated with the plurality of mobile devices, the location data indicating locations for the images of traffic;

storing the traffic image data in a data store to produce stored traffic image data;

processing the traffic image data to identify vehicles viewable in the images of traffic for one or more particular locations;

determining traffic congestion data for the one or more particular locations by processing a subset of the images of traffic corresponding to the one or more particular locations and within a particular date-time window to identify a number of vehicles in the images of traffic, an average distance between the identified vehicles, or both, wherein the subset of the images of traffic are received from multiple mobile devices of the plurality of mobile devices;

storing the traffic congestion data in the data store on a location-by-location basis;

receiving, via the one or more communication networks, a request for at least one of traffic images and traffic congestion data, wherein the request indicates a location and identifies a requesting device;

when the received request includes a request for traffic images, retrieving, responsive to the request, image data from the stored traffic image data and making the retrieved image data available to the requesting device, wherein the retrieved image data pertains to the location; and when the received request includes a request for traffic congestion data, retrieving, responsive to the request, traffic congestion data from the stored traffic congestion data and making the retrieved traffic congestion data available to the requesting device, wherein the retrieved traffic congestion data is correlated with the location.

2. The method of claim 1, wherein the location data is based on satellite location information acquired by the plurality of mobile devices.

3. The method of claim 1, wherein the retrieved image data includes image data for at least one of still images and video.

4. The method of claim 1, wherein making the retrieved image data available to the requesting device comprises:

communicating the retrieved image data to the requesting device in a format capable of being processed for presentation on a display.

5. The method of claim 1, further comprising:

prior to receiving traffic image data from a particular mobile device of the plurality of mobile devices, authenticating the particular mobile device with a corresponding account controlled by the server.

6. The method of claim 1, wherein storing the traffic image data includes storing the traffic image data in association with date and time data, and wherein making the retrieved image data available to the requesting device includes making the date and time data together with the retrieved image data available to the requesting device.

7. A method implemented by a server, the method comprising:

receiving, via one or more communication networks, traffic image data from a plurality of mobile devices, the traffic image data including location data together with image data corresponding to images of traffic on passageways over which the plurality of mobile devices are traveling as captured by cameras associated with the plurality of mobile devices, the location data indicating locations for the images of traffic;

processing the traffic image data to identify vehicles viewable in the images of traffic for one or more particular locations;

determining traffic congestion data for the one or more particular locations based on a number of vehicles identified in the images of traffic for the one or more particular locations, an average distance between the vehicles identified in the images of traffic for the one or more particular locations, or both;

storing one or more of the traffic image data and the traffic congestion data in a data store on a location-by-location basis to produce stored traffic data;

receiving, via the one or more communication networks, a request for at least one of traffic images and traffic congestion information, wherein the request indicates a location and a requesting mobile device;

retrieving, responsive to the request and based on the location, at least one of image data and traffic congestion data from the stored traffic data to produce retrieved traffic data, wherein the retrieved traffic data pertains to the location; and communicating the retrieved traffic data to the requesting mobile device.

8. A server system, comprising:

at least one communication interface coupled to one or more communication networks;

a data store; and a server operably coupled to the data store and the at least one communication interface, the server operable in accordance with executed programmatic instructions to:

receive, via the at least one communication interface, traffic image data communicated over the one or more communication networks from a plurality of mobile devices, the traffic image data including location data together with image data corresponding to images of traffic on passageways over which the plurality of mobile devices are traveling as captured by cameras associated with the plurality of mobile devices, the location data indicating locations for the images of traffic;

store the traffic image data in the data store to produce stored traffic image data;

process the traffic image data to identify vehicles viewable in the images of traffic for one or more particular locations;

determine traffic congestion data for the one or more particular locations by processing a subset of the images of traffic corresponding to the one or more particular locations and within a particular date-time window to identify a number of vehicles in the images of traffic, an average distance between the identified vehicles, or both, wherein the subset of the images of traffic are received from multiple mobile devices of the plurality of mobile devices;

store the traffic congestion data in the data store on a location-by-location basis;

receive, via the at least one communication interface, a request for at least one of traffic images and traffic congestion data, wherein the request indicates a location and identifies a requesting device;

when the received request includes a request for traffic images, retrieve, responsive to the request, image data from the stored traffic image data and make the retrieved image data available to the requesting device, wherein the retrieved image data pertains to the location; and when the received request includes a request for traffic congestion data, retrieve, responsive to the request, traffic congestion data from the stored traffic congestion data and make the retrieved traffic congestion data available to the requesting device, wherein the retrieved traffic congestion data is correlated with the location.

9. The server system of claim 8, wherein the location data is based on satellite location information acquired by the plurality of mobile devices.

10. The server system of claim 8, wherein the retrieved image data includes image data for at least one of still images and video.

11. The server system of claim 8, wherein the server is operable to make the retrieved image data available to the requesting device by:

communicating the retrieved image data to the requesting device in a format capable of being processed for presentation on a display.

12. The server system of claim 8, wherein the server is further operable in accordance with the executed programmatic instructions to:

authenticate a particular mobile device of the plurality of mobile devices with a corresponding account controlled by the server prior to receiving traffic image data from the particular mobile device.

13. The server system of claim 8, wherein the server stores the traffic image data in association with date and time data, and wherein the server is operable to make the retrieved image data available to the requesting device by making the date and time data together with the retrieved image data available to the requesting device.

* * * * *